United States Patent [19]

Boyd

[11] Patent Number: 4,922,845

[45] Date of Patent: May 8, 1990

[54] BOOM FOR A SAILING DEVICE

[75] Inventor: Peter Boyd, Paia, Hi.

[73] Assignee: PDI, Maui, Hi.

[21] Appl. No.: 162,251

[22] Filed: Feb. 29, 1988

[51] Int. Cl.[5] ..... B63B 35/82

[52] U.S. Cl. ..... 114/39.2; 114/97; 114/99

[58] Field of Search ..... 114/39.2, 102, 97–99; 248/316.1

[56] References Cited

U.S. PATENT DOCUMENTS

| | | | |
|---|---|---|---|
| 2,605,778 | 8/1952 | Clapper | 248/316.1 X |
| 3,487,800 | 1/1970 | Schweitzer et al. | 114/39.2 |
| 4,625,671 | 12/1986 | Nishimura | 114/103 |
| 4,633,797 | 1/1987 | Hoyt | 114/91 |
| 4,653,416 | 3/1987 | Dabarge | 114/39 |
| 4,682,557 | 7/1987 | Magruder | 114/39 |

FOREIGN PATENT DOCUMENTS

| | | | |
|---|---|---|---|
| 3014486 | 10/1981 | Fed. Rep. of Germany | 114/39.2 |
| 3411042 | 10/1985 | Fed. Rep. of Germany | 114/97 |

*Primary Examiner*—Sherman D. Basinger

*Attorney, Agent, or Firm*—Donald W. Hanson

[57] ABSTRACT

A multi-level boom adapted for use on a sailing device such as a sailboard. The boom comprises a lower portion in a wishbone type shape having a forward end adapted to be secured to a mast and an aft end adapted for securing the clew of a sail to the boom. The boom further includes at least one elongated tubular member pivotally and slidably secured at one end to the wishbone near the midpoint of one side of the boom and having a clamp at the other end for releasably securing the elongated tubular member to a mast.

4 Claims, 2 Drawing Sheets

BOOM FOR A SAILING DEVICE

The present invention relates to a boom for a wind propelled sailing device and, more particularly, to a multi-level boom especially adapted for a wind propelled sailing device having a pivotally attached mast such as a sailboard, the boom providing greater control over the sail as well as increased performance for the device in a wide variety of wind and surface conditions.

BACKGROUND OF THE INVENTION

Wind propelled sailing devices with pivotally attached masts have enjoyed greatly increasing popularity over the last number of years. These devices can be generally defined as various types of single-person sailing craft in which the operator for the most part stands at all times and the standing operator steers and maneuvers the craft by tilting and turning the mast and associated sail in various directions. Sailing of such devices may be conducted on water, land, ice or snow. The "board" or other hull means on which the operator stands may float or may be wheeled, have runners, skis, and the like. While the subject invention will be primarily described hereinafter with reference to a device for use on water, the device commonly being known as a sailboard, it should be recognized that the invention is not thereby so limited.

Sailboards are vessels generally used for recreational purposes on lakes, oceans and rivers. Sailboards, as is well known, generally comprise a bouyant hull constructed of a core such as foam covered by polymeric materials and the like, one or more downwardly extending keel-like structures such as a daggerboard and rudder, and a sail assembly releasably attached to the hull and connected thereto by a universal type joint which allows the sail assembly to be pivoted or rotated relative to the hull in essentially all directions. The sail assembly typically comprises an elongated mast such as those composed of a tubular length of resin impregnated figerglass, a generally triangular sail capable of being affixed to the mast along the forward edge of the sail and a horizontal "wishbone" type boom attached at one end to the mast and at the other end to the back or clew of the sail, the boom extending along both major surfaces of the sail.

In operation of the sailboard, the user generally stands erect on the hull and supports the sail assembly by grasping one side of the wishbone-shaped boom and then manipulating the sail assembly so as to travel through the water. Control of the orientation of the sail assembly relative to the wind is crucial in maintaining stability ad the desired course and speed for the sailboard. However, a conventional wishbone-shaped boom is many times difficult for a beginning boardsailor to properly control, particularly in heavy winds, as the boom does not provide sufficient leverage in maintaining the proper sail attitude or shape. Furthermore, those boardsailors with more experience in handling such a sailboard oftentimes encounter difficulties in controlling the board in heavy wind conditions or when attempting to negotiate the sailboard through or over high surf or waves.

SUMMARY OF THE INVENTION

It is therefore a feature of the present invention to provide a boom for a sailing device such as a sailboard which provides a greater control over the sail assembly.

It is another feature of the present invention to provide a boom for a sailing device such as a sailboard which enables novice users to more easily master the art of controlling the device.

It is yet a further feature of the present invention to provide a boom for a sailing device which allows an experienced operator to more easily travel long distances.

It is also a feature of the invention to provide a boom for a sailing device which enables the operator to more easily negotiate waves such as surf in either wave riding or wave jumping.

Briefly, in its broader aspects, the present invention comprehends a boom adapted for use on a sailing device such as a sailboard comprising a lower portion in a wishbone type shape having a forward end adapted to be secured to a mast and an aft end including means for securing the clew of a sail to the boom, at least one elongated member, one end of which is pivotally and slidably secured to the wishbone near the midpoint of one side of the boom and having a clamp at the other end for releasably securing the elongated member to a mast.

Further objects, advantages and features of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
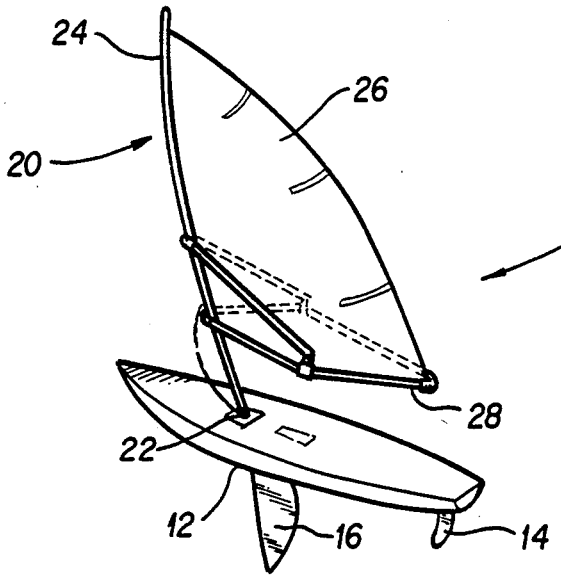
FIG. 1 is a side perspective view of a sailboard incorporating the boom of the present invention.

Referring first to FIG. 1, sailboard sailing device 10, which in this embodiment, comprises a buoyant board or hull 12 which has a fixed fin 14 and removable keel or daggerboard 16 as is conventional in the art. Sail assembly or rig 20 is mounted on board 12 by universal connection 22, the rig comprising an upright mast 24 and a generally triangular sail 26, the leading edge or luff of the sail being supported by the mast. Boom 28 in accordance with the present invention is attached to mast 24 and extends laterally along opposite sides of sail 26 so as to tension the sail and provide a handhold for a sailor to control the sail relative to the wind. With the exception of boom 28 which will be more completely described in connection with the other drawing figures, saidboard 10 is of conventional construction and is well known in the art. As will be readily appreciated by those of skill in the art, hull 12, fin 14, keel 16 and connection 22 can take a variety of forms and designs depending upon the particular type of performance for which sailboard 10 is intended.

Boom 28, as is more clearly illustrated in FIGS. 2–5, is a split level or double type boom which is adapted to provide improved performance for a sailing device such as a sailboard. Boom 28 comprises a lower portion 30 in a basic wishbone type configuration generally composed of a tubular material of a metal such as aluminum or a lightweight polymer. The forward or bow end 32 of lower boom portion 30 is adapted to be releasably secured to mast 24, only a portion of which is shwon, by any suitable conventional means such as a clamp, cord or the like to enable the boom to be adjustable in height relative to the mast. The opposite or stern end 34 of lower boom portion 30 is adapted to retain the clew end of a sail and may include various means such as jam cleats or the like (not shown) for securing an outhaul line from the sail clew to the stern of the boom. The lower wishbone portion 30 of boom 28 is adapted to hold the shape and tension of the sail to the desired extent to maximize performance of the sailboard.

Figure 2:
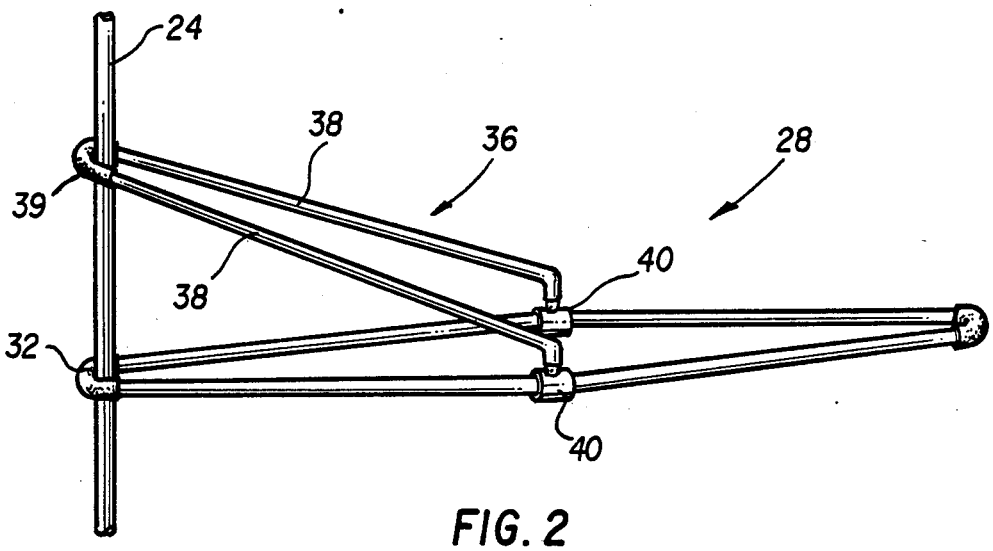
FIG. 2 is a detailed perspective view of one embodiment of a boom according to the present invention.

As is shown in FIG. 2, secured to lower boom portion 30 is an upper level, non-parallel second boom 36 comprising two elongated tubular pipe members 38 which are joined to each other in a generally U-shaped configuration by releasable clamp 39 which is designed and constructed to be affixed to mast 24. The opposite ends of members 38 are each secured to lower wishbone portion 30 of boom 28 by hinges 40. The point of attachment for hinges 40 on the boom portion 30 may vary considerably, but generally it is preferable to locate the hinges approximately midway between the bow and aft of the wishbone boom portion.

As with conventional wishbone booms, it is preferable to coat or cover at least part of lower boom portion 30 and tubular members 38 with a friction-improving material so as to make it easier to grip the boom. Generally, this is a layer of roughened polymeric material applied to the various portions of boom 28.

Figure 3:
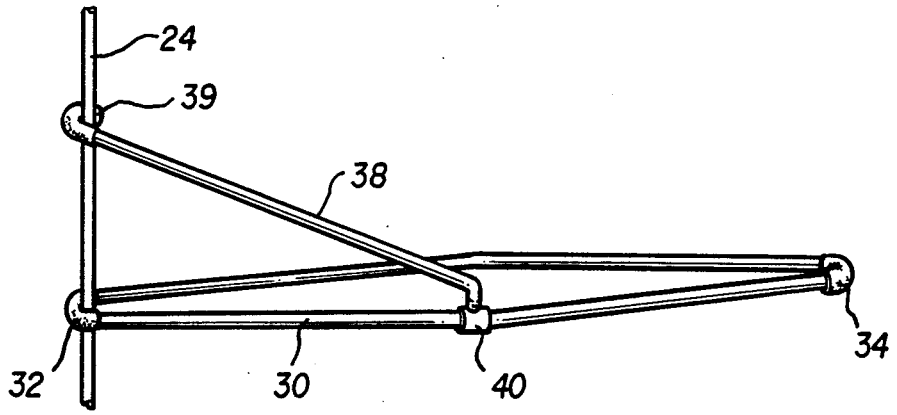
FIG. 3 is a detailed perspective view of another embodiment of a boom according to the present invention.

Another embodiment of a boom in accordance with the invention is illustrated in FIG. 3. Basically, boom 50 of this embodiment is virtually identical to that shown in FIG. 2 with the exception that the upper level boom includes one rather than two elongated tubular members 38 pivotably attached to lower wishbone boom portion 30 by hinge 40.

Figure 4:
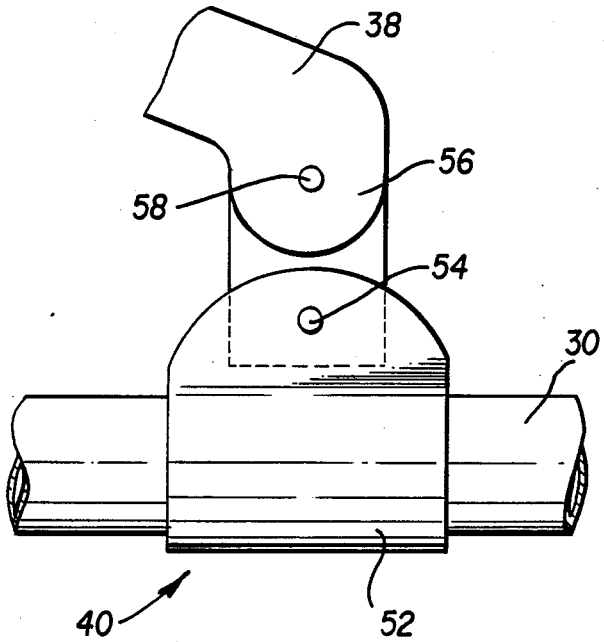
FIG. 4 is a detailed exploded plan view of one embodiment for a hinge forming part of the subject boom.

FIG. 4 is a detailed exploded side view of a presently preferred construction for hinge 40 shown in FIGS. 2 and 3. Hinge 40 comprises a U-shaped bracket 52 of sufficient dimensions to extend around the members forming lower wishbone portion 30 of the boom 28, the bracket extending above the members and having an aperture 54 therethrough. One end of elongated tubular pipe member 38 is provided with flange 56 with corresponding aperture 58, the flange capable of extending into bracket 52 as shown in the dashed lines and secured thereto by a fastener (not shown) which may be a bolt, pin, key or the like. Bracket 52 and flange 56 are not rigidly secured to each other but allow tubular members 38 to pivot relative to the wishbone portion 30. Furthermore, bracket 52 is not tightly secured about lower wishbone portion 30 but is able to be easily positioned all along the length of the wishbone portion.

Figure 5:
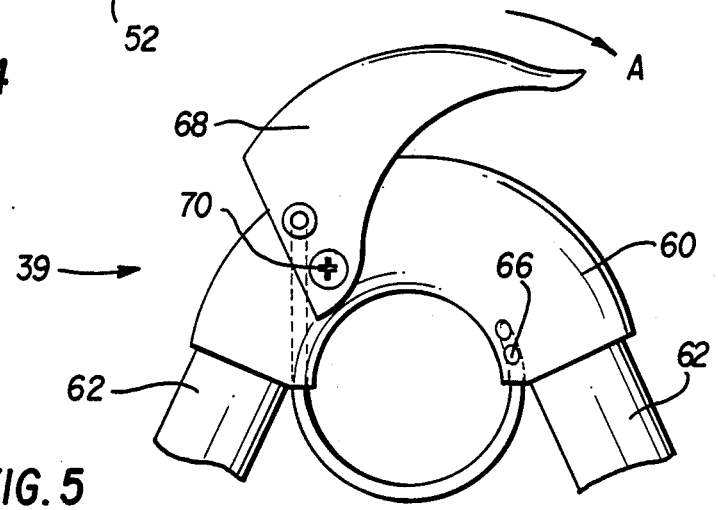
FIG. 5 is a detailed plan view of one embodiment of a clamp for securing a portion of the subject boom to a mast.

FIG. 5 illustrates a preferred construction for clamp 39 adapted for securing elongated tubular pipe members 38 of the upper level boom 36 to mast 24. Clamp 39 comprises semi-circular body 60, the interior size and configuration being such that the body conforms to the external surface of a mast. Body 60 includes at least one, preferably two, mounts 62 to which elongated pipe members 38 may be secured. Attached to body 60 is a flexible member 64 such as a tape or rope which is adapted to extend about a mast. One end of flexible member 64 is fixedly secured to body 60 by one or more fasteners 66 and the other end secured to lever 68 which is pivotally attached to body 60 by pivot 70. As is apparent from FIG. 5, rotation of lever 68 in the direction of arrow A will tighten flexible member 64 about a mast and when the lower passes the "over center" position, clamp 39 will be secured to the mast. Conversely, rotation of lever 68 in the opposite direction will quickly release clamp 39 from the mast.

Although the above description of a preferred embodiment has focused on a boom having two levels, i.e., the lower wishbone portion and the upper level, it is within the contemplation of the present invention to have a boom of three or more levels. For example, boom 28 as shown in FIG. 2 could be provided with a longer set of tubular members which extend to a position aft of where the illustrated members extend and which would also extend to a point higher on the mast. Other variations will be apparent to those of skill in the art with the present invention in mind.

Rigging of the boom of the subject invention on a sailboard generally follows conventional practice with the exception of securing clamp 39 to the mast. If ease of storage or transportation for the boom is a consideration, it may be further necessary to assemble hinges 40 to secure the upper level to the wishbone.

In use of boom 28 of the present invention on a sailing device, upper level 36 of the boom is adjustable to a variety of positions, even when under sail. The operator simply adjusts clamp 39 to the desired position along the mast and due to the pivoting and sliding construction of hinge 40, the elongated members 38 may change orientation without altering the position of lower wishbone portion 30. The boardsailer uses the lower wishbone portion of the boom as one would on a conventional sailboard, generally for generating power for propelling the board. The upper level of the boom, since it is adjustable for height and length, is primarily used for steering purposes and the increased leverage provided thereby allows for better control under virtually all wind and wave conditions.

The booms according to the subject invention provide a number of advantages over conventional booms used for sailing devices such as sailboards. For beginning sailboarders, the upper level of the boom tends to transform body balance into wrist coordination thereby providing more leverage. Consequently, less strength is needed to raise the sail assembly when starting to sail. Furthermore, the added control provided by the construction of the subject boom enables those having limited skills in boardsailing to more quickly master the techniques of maintaining the sail assembly in the upright position and controlling the course of the sailboard in the desired direction. This is due, at least in part, to the ability of the boom to tend to distribute the tension caused by variations in the wind such as gusts and the like thus enabling more even motions in adjusting the trim of the sail and by the boom providing increased leverage against the force of the sail.

For more experienced boardsailors, the boom is quite effective, particularly when using the embodiment shown in FIG. 2, for use in slalom type boardsailing where the boom can be used to control potentially overpowering camber induced sails. Also, when the boom is used on a sailboard in surf conditions for jumping and- /or waveriding, the boom provides additional points of control for the entire sail assembly. As a result, a boardsailor can better prepare for a jump and once aloft in executing the jump, has additional aerial control for properly performing the jump as well as providing for additional safety. When surfing a wave, better balance over the sailboard can be achieved by use of the subject boom.

In non-surf conditions, the relatively experienced boardsailer can adjust the boom for increased speed by setting the lower level wishbone at approximately waist level and the upper level tubular members at approximately shoulder level. such a boom arrangement allows for fine tuning of the sail trim and tends to distribute the body weight of the boardsailor over a larger area to thereby maximize power generated by the sail assembly. On the other hand, for boardsailing long distances, the added control provided by the boom of the invention enables the boardsailor to expend less energy in maintaining the most advantageous attitude for the sail assembly thus allowing longer distances to be achieved with greater safety and comfort.

While there has been shown and described what is considered to be preferred embodiments of the present invention, it will be apparent to those skilled in the art that various changes and modifications may be made therein without departing from the invention as defined in the appended claims.

It is claimed:

1. A boom adapted for use on a sailing device comprising a lower portion in a wishbone type shape having a forward end adapted to be secured to a mast and an aft end including means for securing the clew of a sail to the wishbone, the boom further including two elongated members each pivotally and slidably secured at one end to the wishbone near the midpoint of one side of the wisbone by a hinge slidably secured to the wishbone, the hinge being U-shaped and the ends of the elongated members secured to the hinge being in the shape of a flange, the hinge and the flange being pivotly secured together by a fastener, and a clamp at the other ends of the elongated members for releasably securing the elongated members to a mast.

2. A boom in accordance with claim 1, wherein the clamp for securing the elongated members to a mast comprises a semi-circular body having a flexible member extending across the open portion of the body secured at one end thereto and a lever pivotally mounted on the body, the other end of the flexible member being secured to the lever.

3. A sailboard comprising a hull with at least one keel thereon and a sail assembly attached to the hull with a universal type connection, the sail assembly comprising a mast operatively connected to the connection and a boom secured the mast and the sail, the boom comprising a lower portion in a wishbone type shape having a forward end secured to the mast and an aft end including means for securing the clew of a sail to the wishbone, the boom further including two elongated members each pivotally and slidably secured at one end to the wishbone near the midpoint of one side of the wishbone by a hinge slidably secured to the wishbone, the hinge being U-shaped and the ends of the elongated members secured to the hinge being in the shape of a flange, each hinge and flange being pivotally secured together by a fastener, and a clamp at the other ends of the elongated members for releasably securing the elongated members to the mast.

4. A sailboard in accordance with claim 3, wherein the clamp for securing the elongated members to a mast comprises a semi-circular body having a flexible member extending across the open portion of the body secured at one end thereto and a lever pivotally mounted on the body, the other end of the flexible member being secured to the lever.

* * * * *